US006792775B2

(12) United States Patent
Wang

(10) Patent No.: US 6,792,775 B2
(45) Date of Patent: Sep. 21, 2004

(54) LATCH NEEDLE

(75) Inventor: Zhiyong Wang, Albstadt (DE)

(73) Assignee: Groz-Beckert KG, Albstadt (DE)

( * ) Notice: Subject to any disclaimer, the term of this patent is extended or adjusted under 35 U.S.C. 154(b) by 0 days.

(21) Appl. No.: 10/609,623

(22) Filed: Jul. 1, 2003

(65) Prior Publication Data

US 2004/0011086 A1 Jan. 22, 2004

(30) Foreign Application Priority Data

Jul. 19, 2002 (DE) ..... 102 32 884

(51) Int. Cl.[7] ..... D04B 35/04
(52) U.S. Cl. ..... 66/121
(58) Field of Search ..... 66/116, 117, 118, 66/119, 120, 121, 122, 123, 124

(56) References Cited

U.S. PATENT DOCUMENTS

| | | | | |
|---|---|---|---|---|
| 2,252,302 A | | 8/1941 | Morith | |
| 4,791,794 A | * | 12/1988 | Schmoll | 66/121 |
| 4,827,739 A | * | 5/1989 | Goller et al. | 66/64 |
| 5,956,976 A | * | 9/1999 | Schaffer et al. | 66/121 |
| 6,439,001 B1 | * | 8/2002 | Schaffer | 66/121 |
| 6,510,714 B2 | * | 1/2003 | Dehner | 66/121 |
| 2002/0043083 A1 | | 4/2002 | Schaffer | |

FOREIGN PATENT DOCUMENTS

| | | |
|---|---|---|
| AU | 1113537 | 9/1961 |
| EP | 1197591 | 4/2002 |
| GB | 315185 | 7/1929 |

* cited by examiner

*Primary Examiner*—Danny Worrell
(74) *Attorney, Agent, or Firm*—Venable LLP; Stuart I. Smith

(57) ABSTRACT

A latch needle (1) has a latch spring (19), which assumes the width of the latch slit (5) in the vicinity of the latch seating (18). However, the latch spring (19) is embodied to be narrower on both sides of this section (25). By means of this, premature wear of the latch or spring in the area of the latch seating device (18) is counteracted on the one hand as is, on the other, the obstruction of the latch slit (5) by dust or dirt. The narrower sections (26, 27) of the latch spring (19) define a passage together with the inner face (8, 9) of the slit walls (6, 7), through which foreign bodies, such as fiber remnants, dust or the like can be conveyed from the upper needle side (11) in the direction toward the needle back (12). In contrast to conventional latch needles, needles (1) of this type of construction show reduced wear, a reduced susceptibility to becoming soiled, and therefore increased dependability.

19 Claims, 2 Drawing Sheets

LATCH NEEDLE

Figure 1:
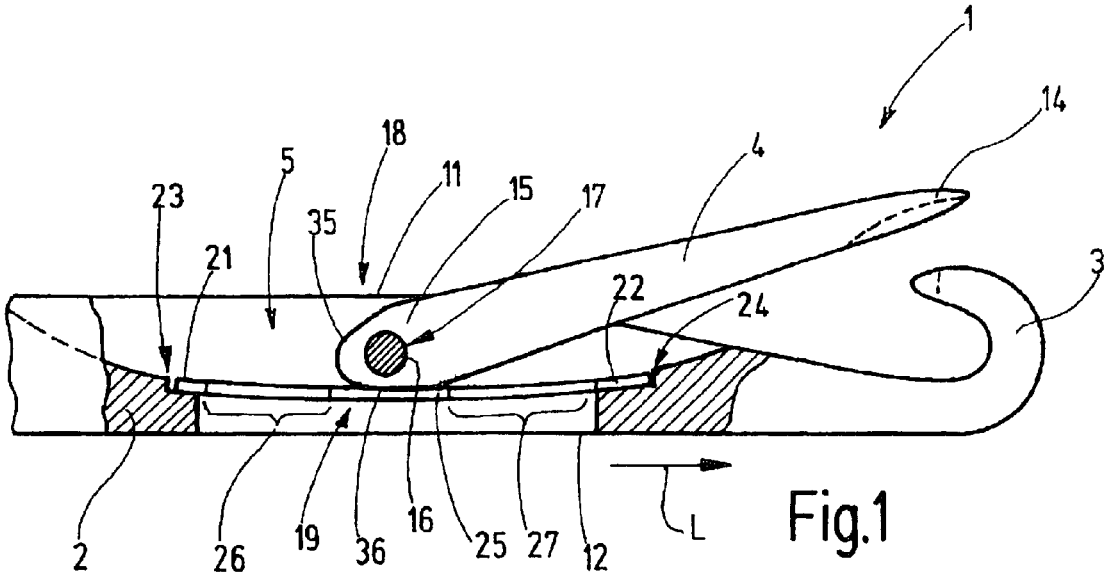

The invention relates to a latch needle with the characteristics of the preamble of claim 1.

A latch needle for knitting machines is known from DE-AS 11 13 537, whose latch is pivotably seated in a latch slit and is in contact with a leaf spring arranged in the latch slit. The leaf spring is used to set defined pivot positions of the latch in the manner of detent positions.

The latch spring rests against the end of the latch located in the latch slit. If the latch is pivoted, the end of the latch rubs against the latch spring. This often leads to wear of the material of the latch and the leaf spring, wherein the leaf spring possibly slowly digs into the end of the latch. Because of this wear of the material, which can take place in an undefined, one-sided and spotty manner, the leaf spring possibly has a tendency to tilt, which has a negative effect on the ability of the latch needle to function.

As a rule, the latch slit forms a passage which is open toward the latch, as well as toward the side facing away from it, the needle back. However, the latch spring closes off this passage to a large extent. As a result, dust and fluff, which occur in particular in the course of processing hair yarn, cannot easily be removed from the latch slit. Instead, dirt tends to collect in the latch slit on top of the latch spring and in the end hampers the orderly functioning of the latch needle.

Based on this it is the object of the invention to produce a latch needle which as a whole is functionally more dependable.

This object is attained by means of the latch needle in accordance with claim 1.

The latch needle in accordance with the invention has a specially designed latch spring, which has at least two areas of different width along its longitudinal extension. For example, it is designed as a leaf spring of rectangular, oval or round cross section, wherein the cross section can be varied over the length of the latch spring, if required. The latch spring has a wider section, which is particularly provided for constituting a contact area for the latch. Wear occurring at the latch end and the leaf spring can be reduced because of the widened surface. Moreover, the leaf spring lies flat against the latch end, which counteracts tilting tendencies of the latch needle.

On the other hand the latch spring has at least one second section in which it is embodied to be narrower. A gap-like passage between the latch needle and the adjoining slit wall is formed because of this. Fluff and rubbed-off particles can leave the latch slit through this passage. Blockage of the latch slit is prevented to a large extent by this.

The capability of the latch needle can be improved because of the reduced wear, because of the prevention of one-sided and merely spotty removal of the material of the latch and the leaf spring, and therefore because of the avoidance of spring tilting or lateral spring deviations, and because of the prevention of fluff collections in the needle slit. This is valid especially during processing of heavy yarn for examples yarn which is hairy or otherwise dispose dust and wear off.

With a preferred embodiment, the ends of the latch needle are seated in spring receivers, or are received therein. The ends of the latch spring preferably have a width approximately corresponding to the latch slit. Because of this the latch spring is seated flat in the spring receivers, which counteracts a tendency of the latch spring to tilt. This can be of particular importance if, for achieving sufficient springiness, the cross section of the latch spring is laterally compressed in the area of reduced width, i.e. if in this area the latch spring has a height, measured parallel with the latch slit wall, which is as great or greater than its width.

The design of the latch spring in accordance with the invention with two sections having different width can be applied to embodiments wherein the latch spring is straight, i.e. elongated, as well as to embodiments wherein the latch spring has one or several bent places. In both cases the latch is preferably widened in the area of the latch seating device, so that it is seated with little play between the almost level latch slit walls. Because of this, the latch spring is provided with good lateral guidance, i.e. it is held centered in the latch slit. (The width of the latch spring is measured transversely in respect to the latch slit, i.e. approximately parallel with the latch seating pin).

Adjoining the area of the latch seating, the latch spring has sections of preferably reduced width. Because of this, a large portion of the cross section of the latch slits on both sides of the latch seating device is kept open for the passage of fluff or other dirt particles. The narrower section of the latch spring preferably extends from the latch seating device as far as the spring seating.

The linear dimensions of the wider section of the latch spring, which is arranged approximately in the center of the latch seating device, are preferably such that no narrower spring section can come into contact with the latch shank end. This means that the entire area or section of the latch spring which can come into contact with the latch takes up nearly the entire slit width. Because of this, latch wear and possibly also spring wear, as well as a tilt tendency of the latch spring, is on the one hand minimized, while on the other hand as free as possible a passage for fluff, rubbed-off particles and dust through the latch slit and past the latch spring is assured.

In a preferred embodiment, the width of the latch spring in the section of reduced width is less than half the width of the slit. It preferably is less than a third of the slit width. By means of this a particularly free passage is achieved.

Regarding its longitudinal axis, the latch spring is preferably designed to be symmetrical. In this case the narrower section of the latch spring is constituted by two recesses provided on both flanks of the latch spring. Such a spring has a particularly reduced tendency to tilt. However, it is also possible to design the latch spring asymmetrically. In this case the latch spring can have a recess on only one side. The recesses ahead of and behind the latch seating device can in this case be provided on different sides of the latch spring in order to make the forces on the spring symmetrical. This embodiment incorporates the advantage of particularly wide and free dirt or fluff passages.

Further details are the subject of the drawings, the description, or of dependent claims.

Figure 2:
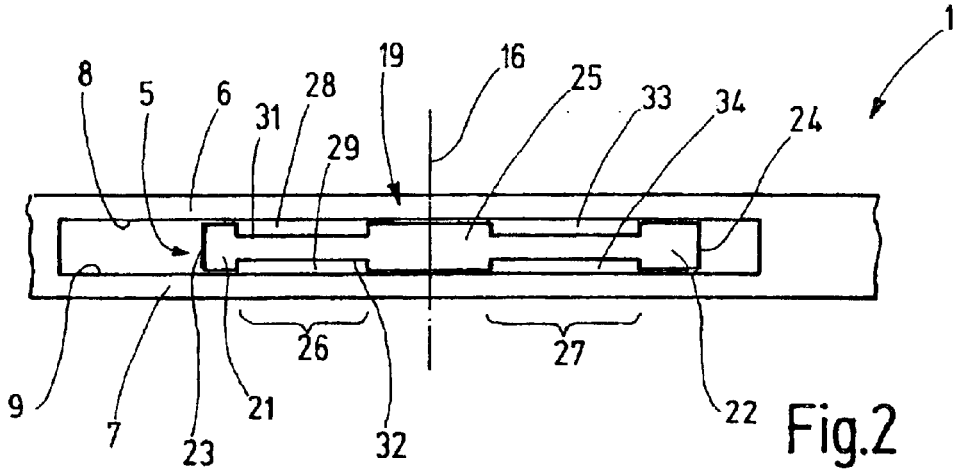
Figure 3:
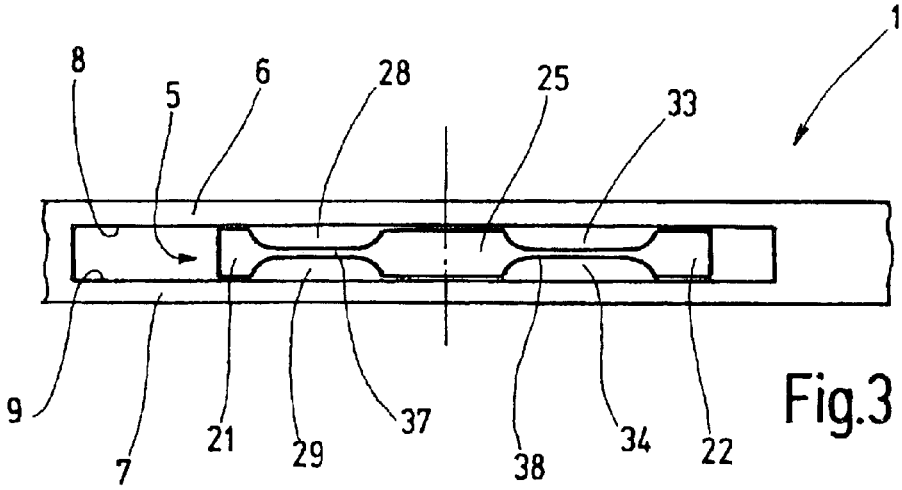
Figure 4:
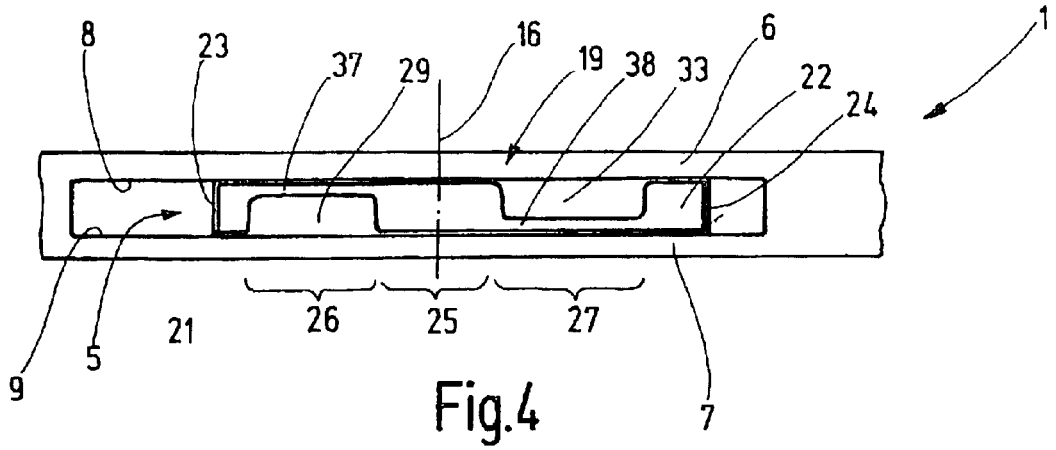
Figure 5:
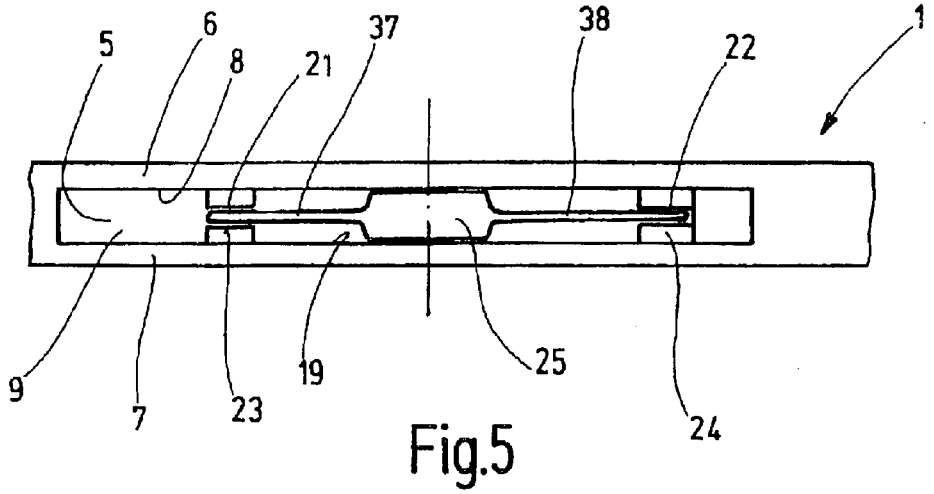
Figure 6:
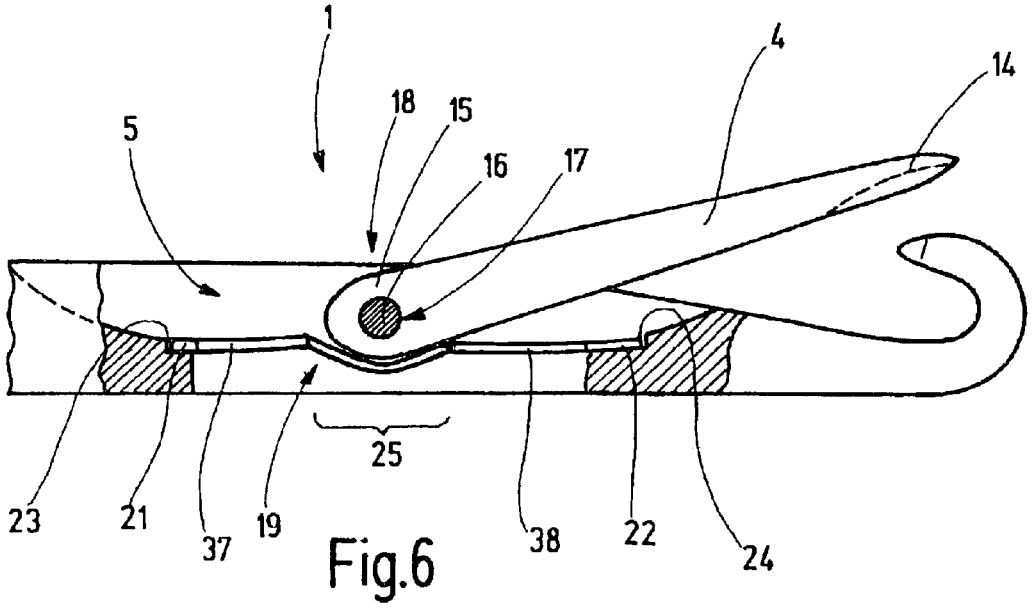

Exemplary embodiments of the invention are illustrated in the drawings. Shown are in:

FIG. 1, a latch needle in a sectional, partially cut representation,

FIG. 2, the latch needle in FIG. 1 without the latch in a view from above, FIGS. 3 to 5, modified embodiments of the latch needle in accordance with FIG. 1 without the latch in views from above, and FIG. 6, a modified embodiment of the latch needle in a partially cut lateral view.

A latch needle 1 with its shank 2, its hook 3 provided thereon and its latch 4 is shown in FIG. 1. The shank 2 has a latch slit 5, whose slit walls 6, 7 have level inner faces 8, 9 facing each other, as can be seen in FIG. 2. The latch slit 5 constitutes a passage which terminates at the needle breast 11, as well as at the needle back 12.

The latch 4, whose spoon 14 can rest against the tip of the hook 3 in a first position, and in a second position can be maximally pivoted away from the hook 3, extends with its latch shank end 15 into the latch slit 5. A seating pin 16 extends through the latter transversely in respect to the shank 2 and passes through the latch shank end 15 at a latch hole 17. The latch shank end 15, together with the shank hole 17, and the seating pin 16 constitute a latch seating device 18 used as a pivot seating for the latch 4.

A latch spring 19 is arranged in the latch slit 5, which rests against the latch 4 and is embodied as a leaf spring. Both its ends 21, 22 are supported in spring seats 23, 24, which are formed in relation to the longitudinal direction L of the shank 2 in the latch slit in front of and behind the latch seating device 18. The spring seats 23, 24 are appropriate pockets or recesses for receiving the ends 21, 22 with little axial and with little lateral play. For example, they can have the same width as the latch slit 5.

The special feature of the latch needle 1 lies in the design of the latch spring 19, which does not have a constant width in the new, unused state in respect to the longitudinal direction L. Instead, in a first section 25, which is arranged below the seating device 18, the width is greater than in at least one second section 26, 27 extending away from the seating device 18. The first section 25 is the area which the latch 4 can reach, or touch, in the course of its pivot movement. The second sections 26 or 27 are those which, in this exemplary embodiment, the latch 4 cannot touch in any pivoted position.

The design of the latch spring 19 can be seen in particular in FIG. 2. In this exemplary embodiment, the latch spring 19 starts with a rectangular profile, for example an appropriate blank of flat spring steel. In the area of each of its ends 21, 22 it has lateral edges located on a common line on both sides of the latch spring 19. The two sides of the latch spring 19 are parallel in respect to each other. They are moreover parallel in respect to the inner faces 8, 9 of the slit walls 6, 7. As seen in FIG. 2, the width of the latch spring 19 is slightly less than the clear width of the latch slit 5. Because of this, the section 25, arranged approximately centered, of the latch spring 19 is maintained with little play in the latch slit 5. It can move freely (vertically in FIG. 1 and perpendicularly to the drawing plane in FIG. 2) in the latch slit 5 without its flanks rubbing against the inner faces 8, 9 of the latch slit 5. However, the section 25 of the latch spring 19 can be only slightly laterally displaced, i.e. the inner faces 8, 9 center, or guide, the latch spring 19 in its section 25.

Preferably the ends 21, 22 have the same width as the section 25. They are therefore also used for centering the latch spring 19 in the latch slit 5. They are preferably seated with a slight amount of axial play in their spring seats 23, 24.

In the section 26, as well as in the section 27, the latch spring 19 is of a lesser width than in the section 25. To this end, in the section 26 the latch spring 19 is provided on both sides with an elongated recess 28, 29, each of which is delimited by a straight edge 31, 32 and in a step makes a transition to the respectively adjoining section, i.e. the end 21 or the area 25. The edges 31, 32 are arranged parallel in respect to each other and embodied to be straight. In this way the recesses 28, 29 form passages for dirt or fluff.

Corresponding recesses 33, 34 are formed in the latch spring in section 27. These recesses, the same as the recesses 28, 29, leave a middle (centered) strip of the spring 19, which is bordered by parallel flanks and, together with the inner walls 8, 9, delimits a slit passage.

In the present exemplary embodiment, the latch spring 19 has a rectangular cross section. The thickness of the latch spring 19, vertically measured perpendicularly in relation to the flat side of the latch spring 19 in FIG. 1, and in FIG. 2 vertically in relation to the drawing plane, is constant in the area of its strips (sections 26, 27), as well as at the ends 21, 22 and in the section 25 as well. Because of this, the bending of the latch spring 19 is concentrated in the sections 26, 27, while the section 25 can be considered to be more like a relatively rigid plate. However, as a whole the latch spring 19 is made in one piece. To prevent tension cracks or other damage, the transitions between the sections 26 and 27 to the section 25 can each be rounded.

The latch spring 19 so far described operates as follows:

During operation, the latch needle 1 performs a reciprocal movement in the direction L. In the course of this movement, the latch 4 performs a pivot movement during which the latch 4 comes into contact with the tip of the hook 3 and is pivoted completely into a rear position as well. In the latter, the spoon 14 is at maximum distance from the hook 3. At times flat places 35, 36 of the latch 4 come into contact with the section 25 of the latch spring 19 in order to resiliently maintain the latch in the respective intermediate position.

During the reciprocal pivoting of the latch 4, the latch shank end 15 rubs against the latch spring 19. However, no edge of the latch spring 19 rests against the latch 4 in the course of this. Instead, the thickness of the latch 4 approximately matches the width of the section 25 of the latch spring 19. Even if the latch is slightly tilted or is laterally pivoted out during the operation, or if the outer face of the latch shank end 15 of the latch 4 does not extend completely parallel in respect to the axis of the pin 6, the latch spring 19 cannot yield laterally because the area 25 centers it in the latch slit 5.

Broken-off filament pieces, dust, rubbed-off particles and the like occurring during the operation can reach the latch slit 5. However, they do not necessarily collect there. The passages provided at the recesses 28, 29, 33, 34 permit the dust and the filaments to be released from the latch slit 5 past the latch spring 19 in the direction toward the needle back 12.

In accordance with FIG. 3, a modified embodiment of the latch needle 1 has a latch spring 19, whose recesses 28, 29, 33, 34 are designed to be deeper, so that the strips 37, 38 remaining of the latch spring 19 are narrower than one-third of the width of the latch slit 5. Furthermore, in this case the strips 37, 38 are not shaped parallel, but slightly pinched. The recesses 28, 29, 33, 34 are embodied approximately trapezoidal, wherein their long edge delimiting the strip 37, 38 is embodied slightly curved. The strips 37, 38 have their thinnest place approximately in the center. The transitions toward the ends 21, 22, as well as to the area 25, can be rounded off.

This embodiment offers particularly large passages for fluff, dust or other dirt, which are released in the direction toward the needle back 12.

While the latch springs 19 of the embodiments of FIGS. 2 and 3 are each designed symmetrical in respect to their longitudinal axis, FIG. 4 illustrates an embodiment which is asymmetrical in respect to the longitudinal direction. With this embodiment, only one recess 29, 33, which is arranged on opposite sides of the latch spring 19, is respectively provided in the section 26, as well as the section 27. In the exemplary embodiment, the remaining strips 37, 38 are narrower than half the width of the latch slit 5. Moreover, they can have the same thickness as the section 25. If required, the strips 21, 22 can be slightly thicker than the ends 21, 22, as well as the section 25. The same applies to the exemplary embodiment in accordance with FIG. 2, as well as in particular to the exemplary embodiment in accordance with FIG. 3. It is possible by means of this to achieve a great stiffness of the spring, along with a maximum passage surface in the area of the recesses 29, 33, i.e. with a minimal width of the strips 37, 38. But a tendency of the latch spring 19 to pivot or tilt is prevented by the flat contact of its ends 21, 22 in the spring seats 23, 24, as well as by its flat contact against the end of the latch.

As illustrated in FIG. 5, it is possible in a further embodiment of the latch spring 19 to omit a broad embodiment of its ends 21, 22. It is possible to let the strips 37, 38 run out at a constant width in the direction toward the ends 21, 22. With this embodiment the spring seats 23, 24 have a constricted taper, so that the ends 21, 22 are maintained centered there. Moreover, the centering of the latch spring 19 again results from the wide design of the latch spring 19 in the section 25.

The section 25 preferably is a center section of the latch spring 19, which is seated at both ends 21, 22. Preferably its length is slightly greater than the area coming into contact with the latch 4. This also applies to the exemplary embodiment in accordance with FIG. 6, wherein the latch spring 19 is embodied crimped in contrast to the exemplary embodiment in accordance with FIG. 1. The latch spring 19 has such a width in the section 25 of the latch seating device 18 that it extends transversely through the entire latch slit 5 and can move in the latch slit 5 without becoming jammed. But outside of the section 25 it tapers, or is designed to be narrower by means of appropriate recesses in accordance with FIGS. 2 to 5. With this exemplary embodiment (FIG. 6) it can also be advantageous to sectionalize the area 26 or the area 27, or both areas 26, 27. In that case extensions are formed inside the recesses 28, 29, 33, 34 (FIG. 2) of the latch spring 19, which extend toward the inner faces 8, 9 and can be used for centering, or constitute a support for the latch 4.

To the extent that no separate information regarding the embodiments in accordance with FIGS. 3 to 6 was provided, the description of the latch needle 1 in accordance with FIGS. 1 and 2 applies, and is based on the same reference symbols.

A latch needle 1 has a latch spring 19, which assumes the width of the latch slit 5 in the vicinity of the latch seating 18. However, the latch spring 19 is embodied to be narrower on both sides of this section 25. By means of this, premature wear of the latch or spring in the area of the latch seating device 18 is counteracted on the one hand as is, on the other, the obstruction of the latch slit 5 by dust or dirt. The narrower sections 26, 27 of the latch spring 19 define a passage together with the inner face 8, 9 of the slit walls 6, 7, through which foreign bodies, such as fiber remnants, dust or the like can be conveyed from the upper needle side 11 in the direction toward the needle back 12. In contrast to conventional latch needles, needles 1 of this type of construction show reduced wear, a reduced susceptibility to becoming soiled, and therefore increased dependability.

List of Reference Symbols

1 Latch needle
2 Shank
3 Hook
4 Latch
5 Latch slit
6, 7 Slit walls
8, 9 Inner faces
11 Needle breast
12 Needle back
14 Spoon
15 Latch shank end
16 Seating pin
17 Latch hole
18 Latch seating device
19 Latch spring
21, 22 Ends
23, 24 Latch seat
25, 26, 27 Area
28, 29 Recess
31, 32 Edge
33, 34 Recesses
35, 36 Flat spots
37, 38 Strips
L Longitudinal direction

What is claimed is:

1. A latch needle for knitting machines, comprising:

a shank supporting a hook, in whose vicinity a latch slit is formed;

a latch, which is pivotably seated in the latch slit (5) in a latch seating device; and a latch spring, which is arranged in the latch slit and maintained in latch seats, wherein in a first section the latch spring has a width which is greater than in a second section, the second section having a cut-out for allowing particles to pass from a latch side of the latch spring to a side opposite the latch side of the latch spring.

2. The latch needle in accordance with claim 1, wherein the latch spring is seated with both of its ends in the latch seats.

3. The latch needle in accordance with claim 1, wherein the latch spring is embodied to be straight.

4. The latch needle in accordance with claim 1, wherein the latch spring is embodied to be crimped.

5. The latch needle in accordance with claim 1, wherein the first section is arranged on the latch seating device.

6. The latch needle in accordance with claim 1, wherein the second section is arranged at a place which is remote from the latch seating device.

7. The latch needle in accordance with claim 1, wherein the length of the first section, measured in the longitudinal spring direction, comprises the entire area of the latch spring which comes into contact with the latch.

8. The latch needle in accordance with claim 1, wherein the length of the second section, measured in the longitudinal spring direction, comprises the entire area existing between the latch seating device and the spring seat.

9. The latch needle in accordance with claim 1, wherein the latch spring is symmetrical.

10. The latch needle in accordance with claim 1, wherein the latch spring is asymmetrical.

11. The latch needle in accordance with claim 1, wherein the width of the latch spring in its first section is at least as large as the width of the latch.

12. The latch needle in accordance with claim 1, wherein the width of the latch spring in its second section is less than half the width of the latch slit.

13. The latch needle in accordance with claim 1, wherein the width of the latch spring in its second section is less than one-third of the width of the latch slit.

14. The latch needle in accordance with claim 1, wherein in relation to the longitudinal direction of the latch spring, second sections are provided on both sides of the latch seating, in which the latch spring is embodied with a lesser width than in the first section arranged on the latch seating device.

15. The latch needle in accordance with claim 1, wherein in relation to the longitudinal direction of the latch spring, a sectionalized second section is provided on at least one side of the latch seating.

16. A latch needle for knitting machines, having a shank supporting a hook, in whose vicinity a latch slit is formed, having a latch, which is pivotably seated in the latch slit in a latch seating device, having a latch spring, which is arranged in the latch slit and maintained in latch seats, characterized in that in a first section the latch spring has a width which is greater than in a second section, and the length of the second section, measured in the longitudinal spring direction, comprises the entire area existing between the latch seating device and the spring seat.

17. A latch needle for knitting machines, having a shank supporting a hook, in whose vicinity a latch slit is formed, having a latch, which is pivotably seated in the latch slit in a latch seating device, having a latch spring, which is arranged in the latch slit and maintained in latch seats, characterized in that in a first section the latch spring has a width which is greater than in a second section, and the width of the latch spring in its first section is at least as large as the width of the latch.

18. A latch needle for knitting machines, having a shank supporting a hook, in whose vicinity a latch slit is formed, having a latch, which is pivotably seated in the latch slit in a latch seating device, having a latch spring, which is arranged in the latch slit and maintained in latch seats, characterized in that in a first section the latch spring has a width which is greater than in a second section, and the width of the latch spring in its second section is less than half the width of the latch slit.

19. The latch needle in accordance with claim 1, wherein the second section is at least 20 percent of a total length of the latch spring.

* * * * *